United States Patent [19]

Ogawa

[11] 4,206,564

[45] Jun. 10, 1980

[54] ARTICULATED RECONFIGURABLE ROBOT DOLL

[75] Inventor: Iwakichi Ogawa, Kashiwa, Japan

[73] Assignee: Takara Co., Ltd., Tokyo, Japan

[21] Appl. No.: 919,301

[22] Filed: Jun. 26, 1978

[51] Int. Cl.[2] ..... A63H 3/12; A63H 3/46; A63H 17/00

[52] U.S. Cl. ..... 46/22; 46/153; 46/163; 46/206

[58] Field of Search ..... 46/22, 206, 103, 202, 46/153, 23, 163, 1 F, 115, 116, 119, 1 E

[56] References Cited

U.S. PATENT DOCUMENTS

| | | | |
|---|---|---|---|
| 3,961,440 | 6/1976 | Saito | 46/206 |
| 4,038,775 | 8/1977 | Sato | 46/22 |
| 4,051,623 | 10/1977 | Ogawa | 46/103 |
| 4,118,888 | 10/1978 | Ogawa | 46/22 |
| 4,141,175 | 2/1979 | Barlow et al. | 46/103 |

OTHER PUBLICATIONS

Oct. 1977 *Playthings,* "Micronauts" advertisement.

*Primary Examiner*—Louis G. Mancene
*Assistant Examiner*—Michael J. Foycik, Jr.
*Attorney, Agent, or Firm*—Jackson, Jones & Price

[57] ABSTRACT

A robot doll made up of a plurality of diverse shaped pieces wherein each pair of pieces are joined together by a press fit joint is disclosed. The pieces that make up the body and limbs of the robot doll are jointed for articulate movement. Each arm features a pair of parallel jointed extensions mounted for articulate movement to a main shoulder piece that is attached to the body piece. The parallel jointed extensions are adapted for grasping a missile launcher. The arms of the robot doll are formed from pieces that become the trunk and leg portions of a smaller toy doll. Small heads and small articulated arms are provided and may be attached by stub-cup joints to the trunk portion of the toy doll, thus converting the robot arm into a smaller toy doll. The trunk portion of the robot doll is formed so that it can be used as the main body portion of a toy airplane. Pieces such as wings, a nose, and tail portion are provided and can be attached to the trunk by press fit joints to form an airplane. The legs of the robot doll are provided with wheels on the backside thereof. The legs are formed so that they can be used as the main part of a carriage for a travelling toy gun.

27 Claims, 5 Drawing Figures

FIG. 3
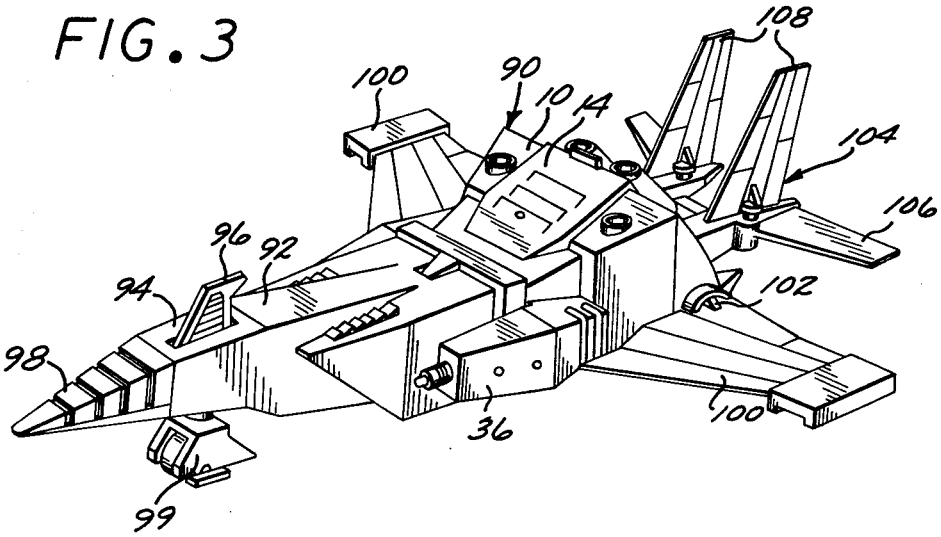
FIG. 4
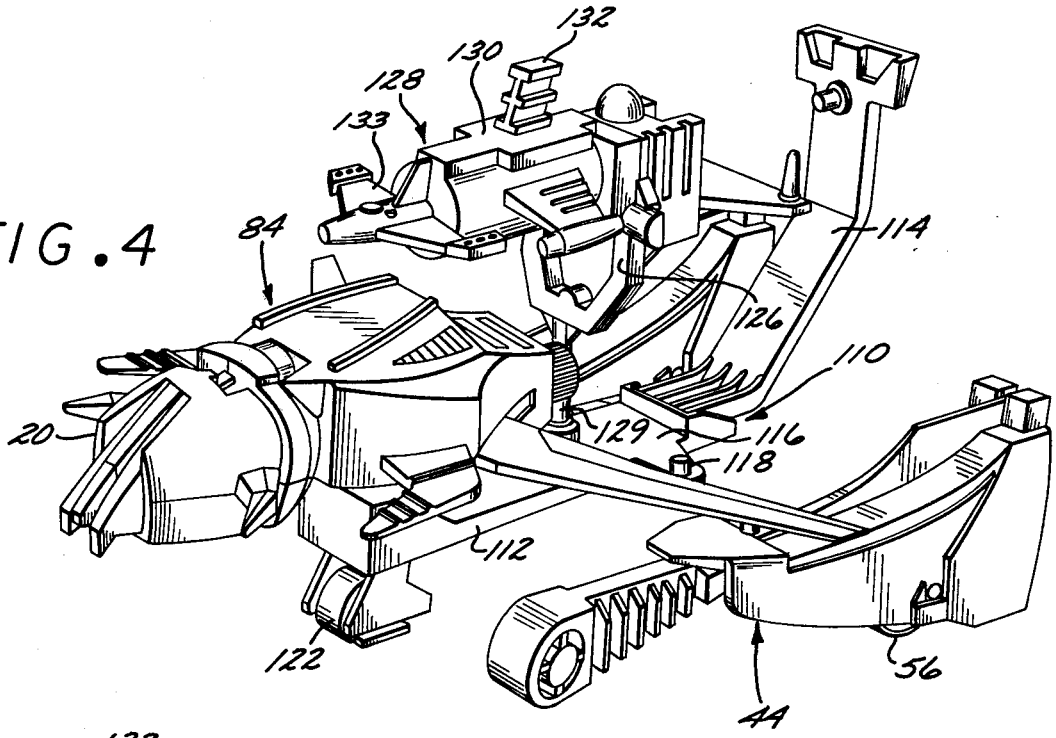
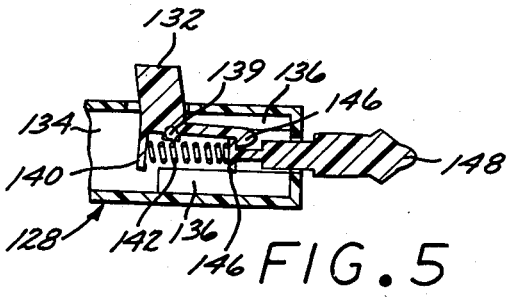
FIG. 5

ARTICULATED RECONFIGURABLE ROBOT DOLL

BACKGROUND OF THE INVENTION

1. Field of the Invention

This invention relates to a robot doll and more particularly to a robot doll built of a plurality of pieces that can be reconfigured to become separate toys and the appendages can become smaller robot dolls.

2. Description of the Prior Art

Toy dolls having removable appendages such as the head, and upper and lower limbs are well known in the toy trade. Various methods are used for joining the removable appendages to the torso portion of the doll. One such method is to use magnet joining. A doll having magnetically held joints is disclosed in U.S. Pat. No. 4,038,775. A robot doll having arms which are capable of ejecting toy missiles is disclosed in U.S. Pat. No. 3,961,440. These dolls are capable of being reconfigured by adding additional parts.

Due to the inherent nature of the toy market, the toy industry is constantly striving to provide toys of unique and useful features which challenge the creative imagination and manual dexterity of the children. The articulated reconfigurable robot doll of the present invention is the result of an effort to provide a toy having such unique and useful features.

OBJECTS AND SUMMARY OF THE INVENTION

It is an object of this invention to provide an articulated reconfigurable doll that has a large number of toy options.

It is another object of this invention to provide an articulated reconfigurable doll that has arms jointed in several places and adapted for rotatably grasping a missile launcher or similar weapon.

It is yet another object of this invention to provide an articulated reconfigurable doll whose arms can serve as the trunk and leg portions of a smaller toy doll.

It is still another object of this invention to provide an articulated reconfigurable doll whose other component parts such as trunk and legs can serve as component parts for other toy objects such as an airplane and a travelling gun carriage.

These objects and the general purpose of this invention are accomplished as follows. Each individual piece of the robot doll has at least one mounting stub or complementary cup or receptacle located therein for mating with an appropriate cup or stub of another piece. Each arm is formed by a pair of parallel jointed extensions which are mounted for articulate movement to a shoulder piece which attaches by a stub-cup pair to the trunk piece of the robot doll. The parallel extensions of each arm are adapted to grasp between them, in a rotatable manner, a weapon such as a missile launcher. The parallel extensions mounted to the shoulder piece, when removed from the trunk of the robot doll, also comprise the trunk and leg portion of a smaller doll. Head and articulated arm pieces are provided which attach to the shoulder piece by stub-cup joints to complete the figure of the small doll. The trunk portion of the robot doll includes wheels in the back, and is adapted, when disassembled from the robot doll, to form the main body portion of a toy airplane. A plurality of wing sections and a front body portion of the toy airplane are attached to the trunk by stub-cup type joints. Articulated leg portions of the robot doll are also provided with wheels and are adapted to comprise the carriage part of a travelling toy gun assembly. Other components of the toy gun assembly include the head portion of the robot doll which becomes the nose cone of the toy gun assembly. The toy gun assembly is also held together by stub-cup type joints.

BRIEF DESCRIPTION OF THE DRAWINGS

Other objects as well as the exact nature of the invention will become readily apparent from consideration of the following detailed description when considered in conjunction with the accompanying drawings in which like reference numerals designate like parts throughout the figures thereof and wherein:

FIG. 3 is a side perspective view of a preferred embodiment of a toy airplane of this invention;

FIG. 4 is a partially exploded side perspective view of a preferred embodiment of a toy gun assembly of this invention, and FIG. 5 is a cross sectional view of a missile launcher of the toy gun assembly of this invention, taken at line 5—5 of FIG. 4.

DESCRIPTION OF THE PREFERRED EMBODIMENTS

Figure 1:
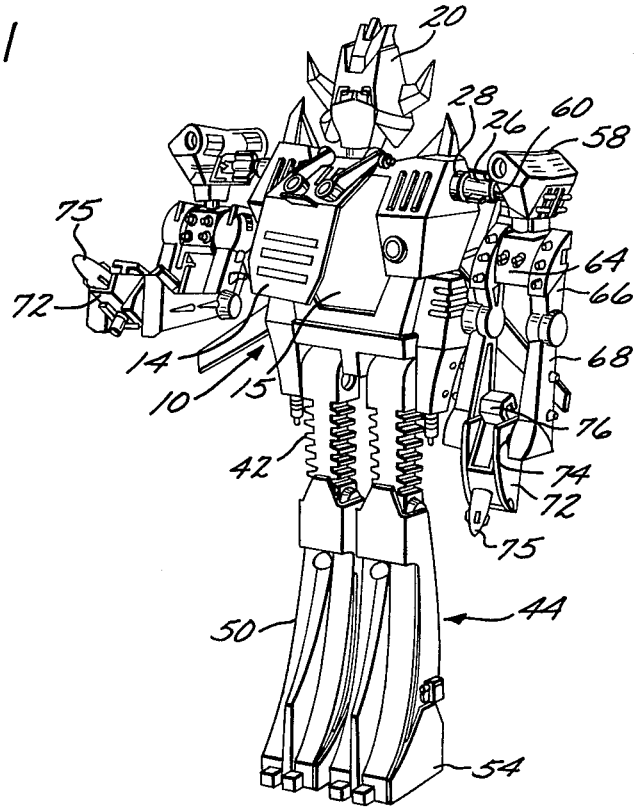
FIG. 1 is a front perspective view of a preferred embodiment of the robot doll.
Figure 2:
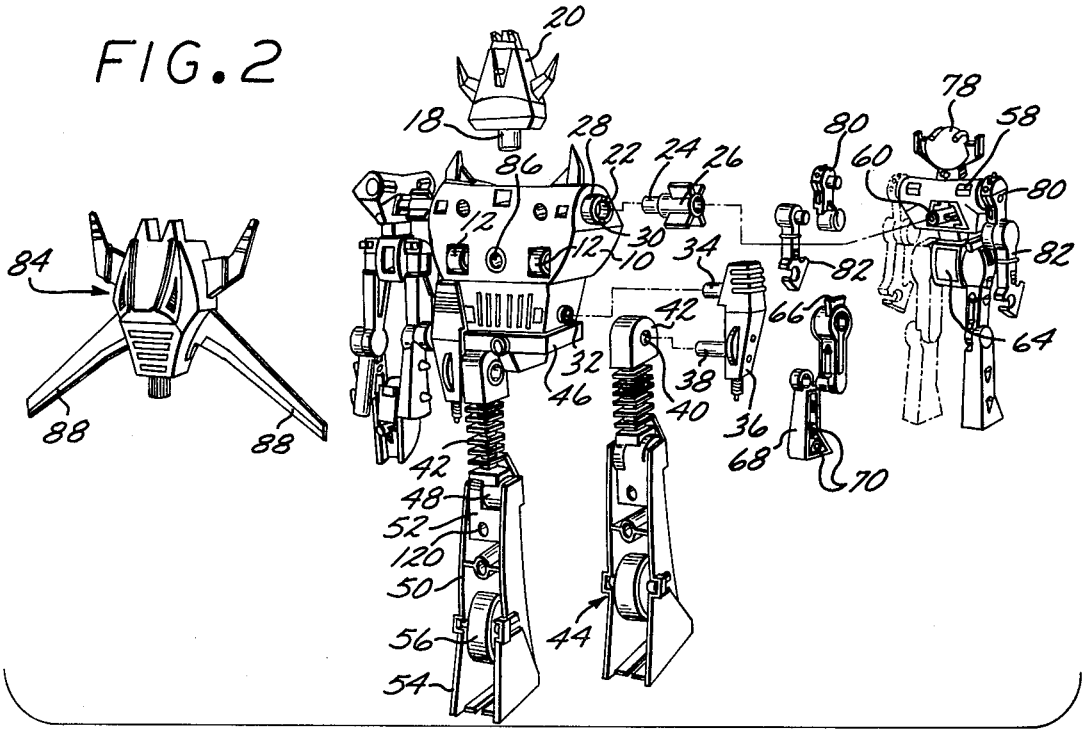
FIG. 2 is a partially exploded back perspective view of a preferred embodiment of the robot doll.

Referring first to FIGS. 1 and 2, a preferred embodiment of the robot doll of the present invention is disclosed. A hollow trunk member 10 simulating the shape of a human torso, is equipped with a pair of wheels 12 in its back periphery. A hinged plate 14 covers a cavity 15 in the front center of the trunk 10. The cavity 15 existing inside the hollow trunk 10 covered by the hinged plate 14 is thus suitable for concealment of small objects.

The trunk 10 is provided with apertures or cups adapted to receive and retain, after press fitting, stubs or mounting posts in other component parts of the toys described here. One such bore or cup 16 (not shown) is located in the top center portion of the trunk 10, and is capable of receiving a matching stub 18 located in the lower center of a highly stylized head 20. A bore or cup 22 is located on each uppwer side of the trunk 10. Each cup 22 is capable of receiving the matching stub 24 of a cylindrically shaped joining member 26. The attachment and structure of the arm portions through this cylindrically shaped joining member will be described below.

The cups 22 located in each upper side of the trunk, unlike the other cups located in the trunk 10, are provided with hollow cylindrical extensions 28, a vertical split 30 being provided in the cylindrical extensions 28. The purpose of the latter will be best understood when the mounting of wing sections to the trunk to make the toy airplane of the present invention is explained below.

An additional bore or cup 32 is provided in substantially the center of each lower side of the trunk 10. Each cup 32 is designed to receive a matching stub 34 located in an elongated joining member 36.

The elongated joining member 36 is provided with an additional stub 38. Stub 38 is designed to engage a matching cup 40 in a thigh portion 42 of a leg assembly 44. Each elongated joining member 36 is dimensioned to fit tightly under a ridge 46 provided in the trunk portion 10, whereby pivotal motion of the elongated joining member 36 in relation to the trunk 10 is eliminated. However the leg assembly 44 is capable of limited rotational movement around stub 38, thus forming a hip joint of the robot doll.

The leg assembly 44 includes the thigh portion 42 which forms a permanently attached knee joint 48 with lower leg 50. The knee joint in this preferred embodiment is also conveniently made up of a stub-cup type assembly, the cup being located in the thigh 42, the stub being part of an additional piece 52 which is secured by a small screw (not shown) in a channel, forming part of the lower leg 50.

Lower leg 50 comprises a substantially channel shaped member, which widens at its lower end thereby forming a foot portion 54. A rotatably mounted wheel 56 is located in the foot portion 54, the wheel being mounted so as to partially protrude toward the back of the robot doll from the channel shaped foot member 54. The purpose and function of wheel 56 will be best understood when the travelling gun assembly of this invention is described below.

Returning to the description of the arm of the robot doll, a main shoulder piece 58, having a substantially trapezoidal shape, is provided with a stub 60 located essentially at its center. This main piece also has a plurality of cups. The stub 60 is received by a cup in the cylindrical joining member 26, thus allowing 360° rotation of the main shoulder piece 58 in relation to the trunk 10.

A cup located in substantially the bottom center of the main shoulder piece 58 receives a stub 62 (not shown) of a lower shoulder member 64. The lower shoulder member 64 is substantially rectangular in shape, and on its two sides is provided with cups to receive, on each side, an upper member of an extension 66. A lower member 68 of the extension is joined to the upper member 66 by stub-cup arrangement, the latter corresponding to the elbow joint of the robot doll. As a result of this arrangement the extensions 66 and 68 constituting the robot doll's arms are capable of 360° rotation with respect to the main shoulder piece 58.

Each lower member 68 of the extension is equipped with a plurality of cups 70 located in such a manner that the cups face each other when the lower extension members 68 are assembled. A spring loaded toy missile launcher 72, having a pair of stubs 74, can be mounted between lower extension members 68. As the toy missile launcher 72 is fixed between the lower extension members, the lower extension members are capable of synchronized pivotal movement around the joints representing the elbow. Due to the above described possibilities of rotational movement of the various parts, the assembled robot doll is capable of grasping the toy missile launcher 72 and pointing it in various directions. The spring loaded toy missile launcher is capable of retaining a toy missile 75 and launching it upon a trigger 72 being depressed.

Each arm assembly of the robot doll when not assembled to the robot doll is capable of forming another toy doll smaller in size than the robot doll. As shown in FIG. 2, a head 78 and a pair of arms consisting of an upper arm member 80 and a lower arm member 82 may be coupled to the main shoulder piece 58 by a stub-cup arrangement. Elbow joints of the arms of the small doll are also made up of stub-cup type couplings. Thus in the smaller doll the upper and lower extension members 66, 68 which formed the arms of the robot doll comprise the legs of the smaller doll.

As an additional feature of the robot doll a rocket-pack member 84 may be mounted by a stub, (not shown) into a cup 86 located between wheels 12 on the back of trunk 10. Thus the robot doll, which by its features has a fierce warrior-like appearance, carries a rocket-pack type member 84 on its back. The rocket-pack type member 84 is provided with a pair of interconnected elongated extensions 88, each of which is mounted on a pivot stem (not shown). As the ends of the extensions 88 mounted on the pivot stem (not shown) are equipped with cogs embracing each other, movement of one extension 88 around the pivot stem (not shown) causes similar movement of the other extension 88.

The rocket-pack type member 84 also incorporates a cup (not shown) in its frontal periphery, enabling the member to be mounted as a component part of the travelling toy gun assembly as will be explained below.

It is to be noted that the trunk 10 is made in the here described preferred embodiment from two complementary pieces of molded plastic material held together by a plurality of screws (not shown). The rocket-pack type member 84 is also conveniently made in the same manner. However, the invention is not intended to be limited to this mode of manufacture.

A particularly significant feature of the present invention lies in the fact that the various component parts of the robot doll are suitable for the construction of other toy objects, thereby giving a child user of the toy an opportunity to assemble various toys from the component parts. The manner of building a smaller toy doll from the arms of the robot doll has already been described.

As a further development of the concept of interchangeability of component parts, the trunk 10 is adapted to be used as the main body section 90 of a toy airplane.

Referring now to FIG. 3, the toy airplane is disclosed. To the trunk portion 10 are attached, in the same manner and location as in the bove described robot doll, the elongated joining members 36. The elongated joining members 36 embrace via stub-cup arrangements two sides of a front body section 92 of the toy airplane. The front body section is elongated in shape and incorporates a spring loaded missile launching assembly 94. The missile launching assembly 94 is capable of retaining, and upon press of a trigger 96, launching a pointed nose cone 98 or other small toy missile. A wheel assembly 99 is mounted by a stub-cup type joint into the front bottom portion of the front body section 90; the rear pair of wheels 12 is provided in the trunk portion 10. The cavity 15 inside the hollow trunk 10 covered by hinged plate 14 is equally suitable, in this embodiment as in the robot doll, for the placement of small objects.

Sides wings 100 each having a stub 102, are mounted into the cups 22 located in the two upper sides of trunk 10. As the stubs 102 of the side wings 100 are press fitted into cups 22 the wings 100 engage the split cylindrical extensions 28 thereby preventing the rotational movement of the side wings 100 in relation to the trunk 10.

The rear wing assembly 104 of the toy airplane incorporates a horizontal wing section 106, and two vertical wings 108. The horizontal wing section 106 is press fitted by a matching stub into cup 16 (not shown), which in the robot doll receives the head 20. The vertical wing sections 108 are attached by stub-cup assembly to the horizontal wing section 106.

Referring now to FIG. 4 the travelling toy gun assembly of the present invention is disclosed. A central plate 110 is built from a straight horizontal section 112 and a bent section 114, the two sections being held together by a stub-cup joint (not shown). The horizontal section 112 of the central plate incorporates a cross bar 116, an upwardly pointing stub 118 being located in each end of the cross bar 116. The two leg assemblies 44 of the robot doll (only one of which is shown on FIG. 4) are mounted to the stub 118 on each side of the central plate to comprise the side sections of the gun carriage. The cups 120 receiving the stubs 118 are shown on FIG. 2. The wheels 56 in the leg assemblies 44 serve as wheels of the gun carriage. A third wheel 122 for the gun carriage is located in the front bottom of the central plate 110, the wheel 122 being attached thereto by a stub-cup type joint (not shown).

The rocket type member 84 is mounted to the front of the central plate 110 by a stub-cup joint (not shown) Here it serves as a front body section of the gun carriage. The head 20 of the robot doll is attached to the front of the member 84 by a stub-cup type joint (not shown) and serves as the nose cone of the travelling gun assembly.

An elongated stem 129 of a fork 126 is press fitted into a cup located in the approximate center of the central plate 110. A stylized toy cannon 128 is mounted for pivotal movement between the forks 126. The toy cannon 128 is equipped with a spring loaded missile or bullet launching assembly 130, which is capable of retaining and upon the press of a trigger 132 launching a projectile. A missile 133 having the shape of an airplane and being held in the toy cannon 128 is shown in FIG. 4.

The cross sectional view of FIG. 5 shows the operation of the toy cannon 128. Parallel plates 136 each having a fork shaped extension 138 are built into a barrel 134 of the cannon 128. The trigger piece 132 is placed between the two plates 136. The trigger piece 132 is capable of limited pivotal movement by virtue of two side stems 139 which are hinged in the forked extensions 138. A downward pointing section 140 of the trigger piece 132 keeps a coil spring 142 in place, while a hook shaped portion 144 of the trigger piece engages a rib 146 on a cylindrical toy missile 148. Upon rearward pressing of the trigger, the trigger piece pivots in relation to the barrel 134. The hook 144 disengages the rib 146 and the toy missile 148 is launched by the compressed coil spring 142.

The construction of the toy missile launcher 72 grasped by the arm of the robot doll, as well as the missile launcher 94 built into the front section 92 of the toy airplane of the present invention is essentially identical with the operation of the toy cannon 128 described here.

In conclusion the above specifications and drawings disclose a highly versatile toy assembly which is readily converted by its user to the various specific embodiments described. Obviously in light of the above teachings various modifications of the present invention are possible and therefore the scope of the invention should be ascertained solely from the appended claims.

What is claimed is:

1. A humanoid doll assembly simulating a robot, the assembly comprising:

a trunk portion;

a first member configured to simulate approximately a head and appropriately positioned on the trunk portion;

a base assembly attached to and supporting the trunk portion;

at least one second member removably mounted on the trunk portion and configured to simulate an arm appendage of the humanoid doll, the arm appendage further configured to include a first portion simulating the chest of a smaller humanoid figure and a second portion articulately connected to the first portion and configured to simulate the legs of the humanoid figure, the second portion comprising a pair of approximately parallel jointed extensions;

a third member configured and sized to simulate a head for the humanoid figure;

a fourth member configured and sized to simulate the arms of the humanoid figure, and means on the second member for connecting the third member head and fourth member arm whereby when the second member is separated from the trunk portion it can receive the third member head and fourth member arms to provide the separate smaller humanoid figure as a subassembly toy.

2. The invention of claim 1 wherein the first portion of the arm appendage comprises a main shoulder piece appropriately and removably mounted to the trunk portion, and a lower shoulder member mounted to the main shoulder piece.

3. The invention of claim 2 further comprising a cylindrical joining member which incorporates a stub capable of being press fitted into the trunk portion and a bore, wherein the main shoulder piece is attached to the bore in the cylindrical joining member, the pair of parallel jointed extensions are attached for limited rotational movement to the lower shoulder member.

4. The invention of claim 3 further comprising at least one spring loaded missile launcher having means for retaining and launching toy missiles the missile launcher being provided with means for removably and pivotally mounting it between the parallel jointed extensions.

5. The invention of claim 1 wherein the trunk portion incorporates a cavity and includes a hinged breast plate covering the cavity whereby a small object may be placed in the trunk portion.

6. The invention of claim 1 further comprising a rocket pack member, the rocket pack member being removably mounted to the back of the trunk portion.

7. The invention of claim 1 further comprising at least a pair of toy wing sections, and a front body section of a toy airplane and wherein the trunk portion has substantially the shape of an elongated rectangle, includes a pair of wheels rotatively mounted in its back periphery and is provided with means for mounting the wing and front body sections whereby the trunk portion when separated from the humanoid doll and mounted to the wing and front body sections effectively simulates the toy airplane.

8. The invention of claim 7 wherein the means for mounting the wing and front body sections of the toy airplane comprise a plurality of stub-cup type assemblies.

9. The invention of claim 1 wherein the base assembly comprises a pair of leg members, each leg member being attached to the trunk portion.

10. The invention of claim 9 wherein each leg member is articulated.

11. The invention of claim 9 wherein each leg member comprises a substantially channel shaped lower member incorporating a wheel rotatively mounted therein whereby the leg member is configured to simulate a carriage portion of a traveling toy gun.

12. The invention of claim 11 further comprising a pair of elongated joining members, each elongated joining member being mounted to the trunk portion by stub-cup type assembly and each leg member being mounted to a respective elongated joining member by a stub-cup type assembly.

13. In a humanoid doll assembly having the shape and configuration of a warrior and the like and having appendages attached to a trunk portion, the improvement comprising:

at least one appendage being removably mounted to the trunk portion and configured to simulate substantially the anatomy of a second smaller humanoid doll when removed from the trunk portion of the humanoid doll assembly.

14. The invention of claim 13 wherein the removable appendage comprises a first member configured and simulated to represent a torso and a pair of second members configured and simulated to represent legs, the invention further including a pair of third members configured and simulated to represent arms and a fourth member configured and simulated to represent a head, the third members and fourth member can be removably attached to the torso to complete the second smaller humanoid doll.

15. A toy airplane assembly effectively simulating the appearance of a fighter aircraft and capable of reconfiguration into subcombination toys, the assembly comprising:

a main body section having means for removably attaching the same to a head portion and limb portions of a humanoid robot doll whereby the main body section is configured to simulate a trunk portion of the humanoid robot doll;

a front body section removably attached to one end of the main body section, and a plurality of wing sections, each wing section being removably mounted to the main body section.

16. The toy airplane assembly of claim 15 further comprising a wheel assembly removably mounted to the front body section by a stub-cup type joint.

17. The toy airplane assembly of claim 15 further comprising a pair of elongated joining members, each of the joining members being removably mounted by stub-cup type joints to the main body section and to the front body section, whereby the main body and front body sections are removably jointed together.

18. The toy airplane assembly of claim 17 wherein the front body section further comprises a spring loaded toy missile launcher having means for retaining and launching toy missiles.

19. The toy airplane assembly of claim 18 further comprising a nose cone section being retained and capable of being launched by the toy missile launcher.

20. The toy airplane of claim 15 wherein the main body section includes a hinged breast plate covering a cavity within the main body section whereby a small object may be placed in the cavity of the main body section.

21. The toy airplane of claim 15 wherein the main body section incorporates a wheel.

22. The toy airplane of claim 15 wherein the means for attaching the main body section to the head portion and to the limb portions of the humanoid robot doll comprise stub-cup type joints.

23. A travelling toy gun assembly capable of being reconfigured, into subcombinations of toys comprising:

a gun carriage having a plurality of wheels;

a front body section removably connected to the gun carriage, the front body section having means for removably attaching it to a trunk portion of a humanoid robot doll, and having a pair of elongated extensions whereby the front body section is configured to simulate a rocket-pack;

a nose cone removably connected to the front body section, and a toy gun removably mounted to the gun carriage behind said front body section.

24. The invention of claim 23 wherein the nose cone includes means for attaching it to the trunk portion of the humanoid robot doll, the nose cone being shaped to simulate a head of the humanoid robot doll.

25. The invention of claim 23 wherein the gun carriage further comprises a central plate and a pair of articulated members, each articulated member incorporating a wheel and being removably mounted to the central plate.

26. The invention of claim 25 wherein each articulated member is configured to simulate a leg of the humanoid robot doll, and is provided with means for attaching it to a trunk portion of the humanoid robot doll as a subcombination toy.

27. The invention of claim 23 wherein the toy gun further comprises a spring loaded toy missile launcher having means for retaining and launching toy missiles.

* * * * *